United States Patent [19]

Fukizawa et al.

[11] Patent Number: 4,889,774

[45] Date of Patent: Dec. 26, 1989

[54] CARBON-FIBER-REINFORCED METALLIC MATERIAL AND METHOD OF PRODUCING THE SAME

[75] Inventors: Kazunori Fukizawa, Kiyose; Toyoko Ohshima; Toshinobu Hata, both of Tokyo, all of Japan

[73] Assignee: Honda Giken Kogyo Kabushiki Kaisha, Tokyo, Japan

[21] Appl. No.: 870,050

[22] Filed: Jun. 3, 1986

[30] Foreign Application Priority Data

Jun. 3, 1985 [JP] Japan ..... 60-120163
Jul. 3, 1985 [JP] Japan ..... 60-146240

[51] Int. Cl.[4] ..... C22C 1/09; B22D 19/14
[52] U.S. Cl. ..... 428/614; 164/97
[58] Field of Search ..... 164/97, 108, 109, 110, 164/53, 54; 428/614

[56] References Cited

U.S. PATENT DOCUMENTS

| | | | |
|---|---|---|---|
| 4,056,874 | 11/1977 | Kalnin | 420/402 |
| 4,572,271 | 2/1986 | Nakashima | 164/97 |
| 4,590,132 | 5/1986 | Dohnomoto et al. | 428/614 |
| 4,600,661 | 7/1986 | Dohnomoto | 428/614 |
| 4,601,956 | 7/1986 | Dohnomoto | 428/614 |

FOREIGN PATENT DOCUMENTS

| | | | |
|---|---|---|---|
| 141960 | 11/1981 | Japan | 164/97 |
| 31466 | 2/1982 | Japan | 164/97 |
| 67336 | 4/1984 | Japan | 164/53 |
| 2129342A | 5/1984 | United Kingdom | 164/97 |

OTHER PUBLICATIONS

Metals Handbook, 9th Ed., vol. 2, American Society for Metals, 1979, p. 528, Magnesium Alloys–Table 3.

*Primary Examiner*—John J. Zimmerman
*Attorney, Agent, or Firm*—Armstrong, Nikaido Marmelstein Kubovcik & Murray

[57] ABSTRACT

Carbon fibers are mixed with a metal powder oxidizable to generate heat and the mixture is formed into a shaped article. The fiber shaped article is heated in a non-oxidative atmosphere in a preheating furnace and then, a molten metal is filled into the fiber shaped article and solidified, while permitting the metal powder to be oxidized to generate heat in the atmosphere.

For a magnesium alloy used as a matrix, the aluminum content thereof is set within a range of 0.3 to 5.0% by weight.

5 Claims, 6 Drawing Sheets

CARBON-FIBER-REINFORCED METALLIC MATERIAL AND METHOD OF PRODUCING THE SAME

BACKGROUND OF THE INVENTION

1. Field of the Invention

The present invention relates to a carbon fiber-reinforced metallic material and a method of producing the same.

2. Description of the Prior Art

One method of producing such a metallic material which is conventionally known comprises forming a fiber shaped article having a predetermined bulk density from carbon fibers, preheating the fiber shaped article in a nonoxidative atmosphere in a preheating furnace to a predetermined temperature in order to enhance the filling property of the fiber shaped article with a molten metal and then, withdrawing the fiber shaped article out of the preheating furnace into the atmosphere to place it into a mold and pouring a molten metal into the mold to fill the fiber shaped article with the molten metal and solidify the molten metal.

However, the above method is accompanied by a problem that the carbon fibers after being preheated immediately starts to be oxidized in the atmosphere, resulting in a substantially reduced tensile strength, and for this reason, it is impossible to achieve fully the reinforcement of a metallic material with fibers.

A method is also known in which a magnesium alloy in the form of a melt is filled into a fiber shaped article formed from carbon fibers and then solidified by utilizing a high pressure solidification casting process. In such a case, an alloy for cast products is employed as the magnesium alloy.

With this method, however, problems are encountered. The alloy for cast products contains aluminum in a large amount of 5 to 10% by weight and therefore, such aluminum easily reacts with carbon fibers to form a large amount of an embrittled layer, thus considerably reducing the tensile strength of the carbon fiber.

In addition, with the increase in aluminum content, the formation is increased of the layer of an intermetallic compound such as $Al_{12}Mg_{17}$ in the matrix. This layer has a tensile strength of 8 to 12 kg/mm$^2$ and an elongation of 0.3 to 0.5% and thus, is very brittle. Moreover, the layer tends to segregate on the carbon fiber surface or in the vicinity thereof, resulting in that a notch is formed due to the initial fracture of such layer and with the progression of the formation, the tensile strength of the resultant material is remarkably reduced.

SUMMARY OF THE INVENTION

It is an object of the present invention to provide a method of producing a carbon fiber-reinforced metallic material having an excellent strength and being free from the above problems and such a metallic material thus produced.

To accomplish such object, according to a first aspect of the present invention, there is provided a method of producing a metallic material reinforced with carbon fibers, which comprises the steps of preheating, in a non-oxidative atmosphere in a preheating furnace, a fiber shaped article formed from the mixture of carbon fibers with a metal powder oxidizable to generate heat prior to the carbon fibers, withdrawing the fiber shaped article out of the preheating furnace into the atmosphere, thereby permitting the metal powder to be oxidized to generate heat, placing the fiber shaped article in a mold with the metal powder left to be oxidized to generate heat, and pouring a molten metal into the mold to fill the fiber shaped article with the molten metal and to solidify the molten metal.

The generation of heat from the preferential oxidation of the metal powder causes oxygen around the carbon fibers to be thinned, thereby making it possible to inhibit the oxidation of the carbon fibers to prevent the reduction of the tensile strength thereof to a minimum extent.

In addition, since the fiber shaped article is maintained at a temperature due to the generation of heat from the oxidation of the metal powder, the filling property of the fiber shaped article with a molten metal can be improved.

Further, according to a second aspect of the present invention, there is provided a carbon fiber-reinforced metallic material in which carbon fiber is used as a reinforcing fiber and a matrix is constituted of a magnesium alloy, wherein the aluminum content of the magnesium alloy is set at 0.3% to 5.0% by weight.

With this feature, since the aluminum content of the magnesium alloy is set at 0.3% to 5.0% by weight, it is possible to provide such a carbon fiber-reinforced metallic material having a tensile strength sufficient for practical use, in which the formation of an embrittled layer is reduced due to the reaction of the carbon fibers with aluminum and of an intermetallic compound layer such as $Al_{12}Mg_{17}$ in the matrix.

Contrary to this feature, if the aluminum content exceeds 5.0% by weight, the tensile strength of the resulting material is suddenly reduced and hence, such material cannot be provided for the practical use by any possibility. On the other hand, if the aluminum content is less than 0.3% by weight, the casting performance may be significantly degraded, resulting in a reduced throughput.

The above and other objects, feature and advantages of the invention will become apparent from the following description taken in conjunction with the accompanying drawings.

DESCRIPTION OF THE PREFERRED EMBODIMENT

Used as a metal powder oxidizable prior to carbon fiber to generate heat is at least one powder selected from the group consisting of Ti, Zr and Fe powders, or mixture of these powders.

The temperature of heat generated from the oxidation of Ti powder is of 700° to 800° C. and hence, the temperature of preheating of a fiber shaped article formed from the carbon fibers containing the Ti powder blended thereto is set at level of 700° C. or more. In this case, because of the temperature of fusing of a light alloy, such as aluminum alloys, magnesium alloys, etc., which is a matrix, the temperature of preheating of the fiber shaped article containing Ti powder is set on the order of 800° C. for the purpose of enhancing the filling property of a molten metal consisting of the aforesaid light alloy.

The temperature of heat generated from the oxidation of Zr and Fe powders is as low as 400° C., but the temperature of preheating of a fiber shaped article containing Zr or Fe powder is set at a level of 600° C. or more, in view of the filling property of a molten metal as described above.

Description will now be made of the procedure for producing a carbon fiber-reinforced metallic material.

To $9\times10^5$ of carbon fibers having a diameter of 7 μm are added one liter of a binder produced by dissolving in acetone an acrylic resin (available under a trade name of ORIBINE) containing 25% of a curing agent, and 100 g of Ti powder having a diameter of 4 μm, and these components are thoroughly mixed.

The resulting mixture is inserted into a heat-resisting glass pipe having a diameter of 12 mm and then, the heat-resisting glass pipe is placed in a kiln. Firing is conducted for one hour at 400° C. while allowing hydrogen gas to flow through the kiln, thereby giving a rod-like fiber shaped article having a bulk density of 1.3 $g/cm^3$.

Then, the fiber shaped article is placed in a preheating furnace and is preheated for 15 minutes at 800° C. while allowing argon gas to flow therethrough to provide a non-oxidative atmosphere for the interior of the furnace.

Upon withdrawing the fiber shaped article after preheating, the Ti powder in the fiber shaped article is oxidized prior to the carbon fibers to generate heat and consequently, the temperatures of the outer peripheral surface of and the core of the fiber shaped article increase to about 1150° C. and about 1000° C., respectively.

Thereafter, the fiber shaped article is immediately placed into a cavity in a mold heated to 300° C., and the melt (i.e., molten metal), at a temperature of 750° C., of a magnesium alloy (ASTM AS41 material) is filled into the fiber shaped article under a condition of Ti powder being oxidized to generate heat and is then solidified.

Through the above steps, a carbon fiber-reinforced metallic material containing a magnesium alloy as a matrix is obtained. The carbon fiber content by weight (Vf) of this metallic material is of about 25%.

Figure 1A:
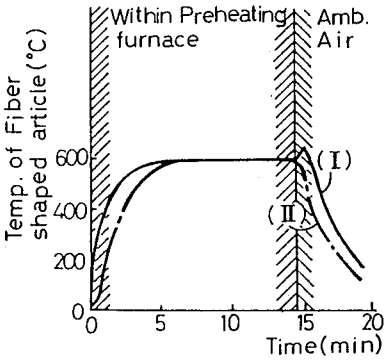
FIG. 1 is a graph illustrating the relationship between the temperature of a fiber shaped article having Ti powder and the time.
Figure 1B:
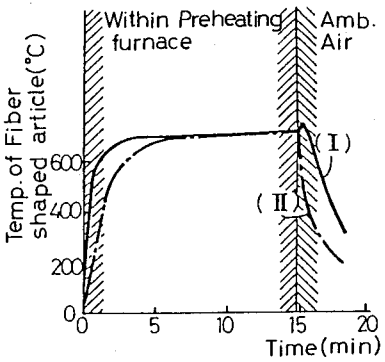
Figure 1C:
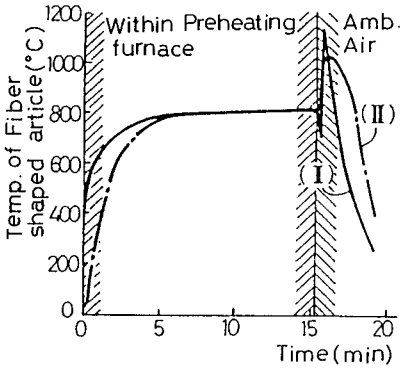

FIGS. 1*a* to 1*c* illustrate a relationship between the temperature of the fiber shaped article and the time when the temperature of preheating of a rod-like fiber shaped article containing the Ti powder is set at 600° C., 700° C. and 800° C., respectively. In these Figures, a line (I) represents the temperature of the outer peripheral surface of the fiber shaped article, and a line (II) designates the temperature of the core of the fiber shaped article. The determination of these temperatures is carried out by use of a single one thermocouple mounted on the outer peripheral surface of the fiber shaped article and a single one thermocouple inserted into the core of the fiber shaped article.

As is apparent from FIG. 1*c*, if the fiber shaped article is put into the atmosphere after preheating thereof for 15 minutes at 800° C., the temperatures of the outer peripheral surface of and the core of the fiber shaped article reach about 1150° C. and about 1000° C. Respectively, due to the heat generated from the oxidation of the Ti powder. With the preheating temperature of 600° C. and 700° C., it is apparent from FIGS. 1*a* and 1*b* that because of a smaller amount of heat generated from the oxidation of the Ti powder, the temperature of the fiber shaped article is correspondingly lower.

Figure 2A:
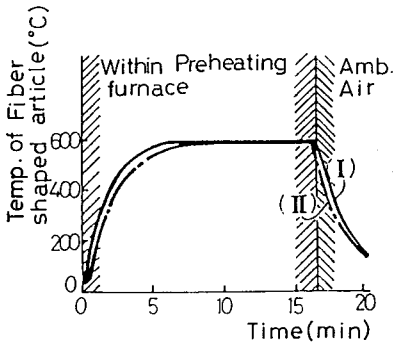
FIG. 2 is a graph illustrating the relationship between the temperature of a fiber shaped article free of Ti powder and the time.
Figure 2B:
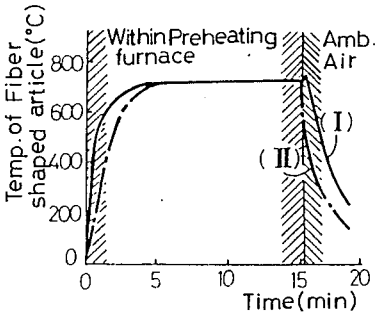
Figure 2C:
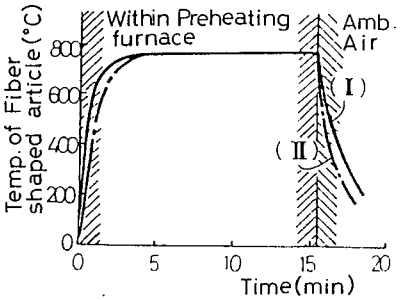

Figs. 2*a* to 2*c* illustrate a relationship between the temperature of the fiber shaped article and the time when the temperature of preheating of a rod-like fiber shaped article free of the aforesaid Ti powder is set at 600° C., 700° C. and 800° C., respectively. As is apparent from these Figures, when the fiber shaped article is free of the Ti powder, the increase in temperature in the atmosphere after preheating is little observed.

Figure 3:
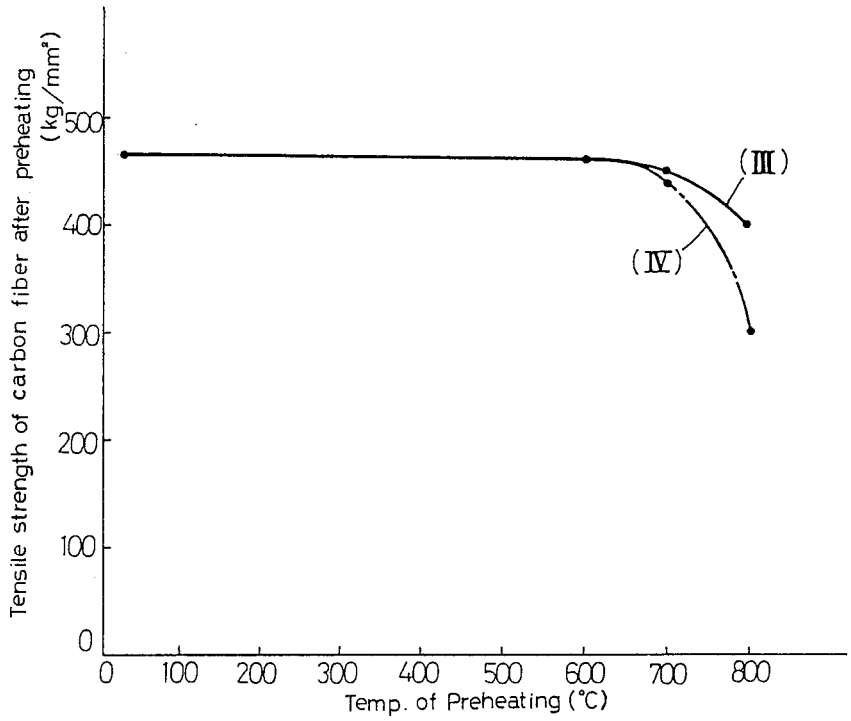
FIG. 3 is a graph illustrating the relationship between the preheating temperature and the tensile strength of the carbon fibers after preheating.

FIG. 3 illustrates a relationship between the preheating temperature and the tensile strength of the carbon fibers (short fibers) after being preheated, wherein a line (III) corresponds to the carbon fibers in fiber shaped article containing the Ti powder and a line (IV) to the carbon fibers in the fiber shaped article free of the Ti powder.

As is apparent from FIG. 3, it has been observed that with the preheating temperature of 600° C., the tensile strength of the carbon fibers is almost constant. But with the fiber shaped article free of the Ti powder, the tensile strength of the carbon fibers is reduced as compared with that of the carbon fibers in the fiber shaped article containing the Ti powder, as the preheating temperature increases to 700° C. and 800° C. This is attributable to the fact that in the fiber shaped article containing the Ti powder, the oxidation of the carbon fibers is inhibited due to the generation of heat from the oxidation of the Ti powder, but the carbon fibers in the fiber shaped article free of the Ti powder start to be oxidized immediately after preheated.

Figure 4:
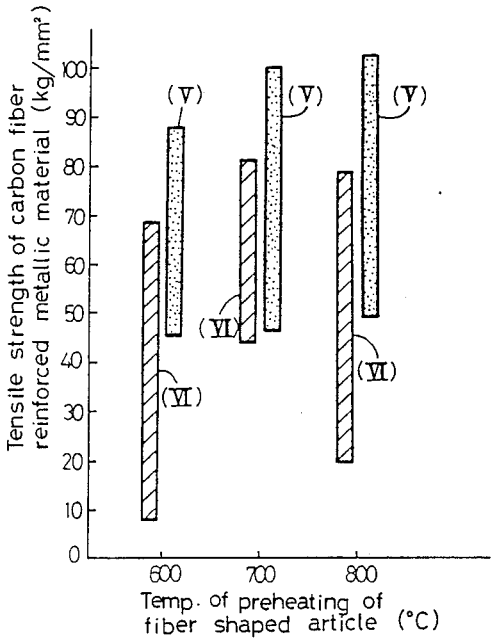
FIG. 4 is a graph illustrating the relationship between the temperature of preheating of the fiber shaped article and the tensile strength of a carbon fiber-reinforced metallic material.

FIG. 4 illustrates a relationship between the tensile strength of carbon fiber-reinforced metallic material containing a magnesium alloy as a matrix and the temperature of preheating of fiber shaped article. In this Figure, the reference character (V) corresponds to the material employing the fiber shaped article containing the Ti powder, and (VI) corresponds to the material employing the fiber shaped aricle free of the Ti powder.

As is apparent from FIG. 4, when the fiber shaped article containing the Ti powder is used, the oxidation of carbon fiber is suppressed by the generation of heat from the oxidation of the Ti powder and the fiber shaped article is maintained at a temperature, and hence, it is possible to provide a material having the fiber shaped article satisfactorily filled with a molten metal and having greater tensile strength.

Figure 5A:
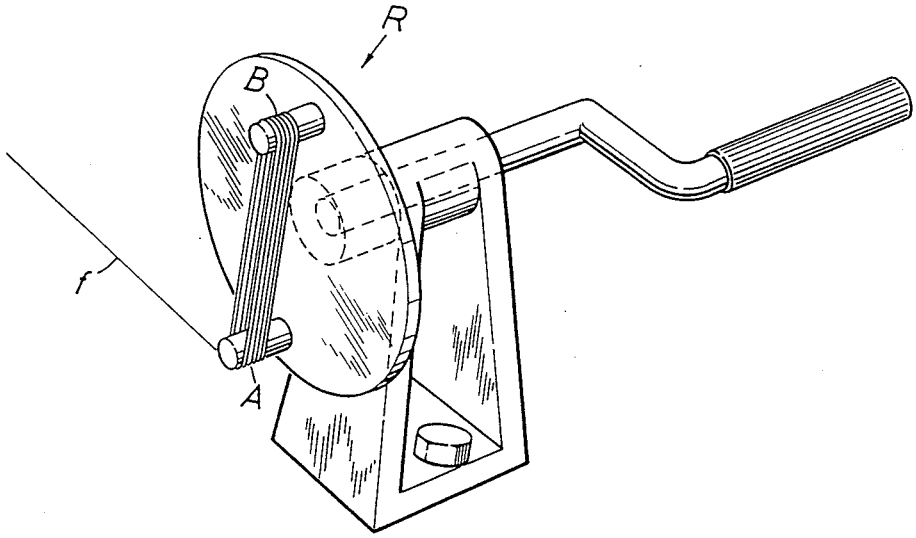
FIG. 5 is a view for illustrating the steps of producing the fiber shaped article.

FIGS. 5*a* to 5*d* illustrate the sequence for producing a carbon fiber shaped article,. As shown in FIG. 5*a*, using a winder R of a manually turning type, the long fiber of carbon fiber (TORECA T300 made by Toray Corp.) having a diameter of 7 μm is taken up in loop and the takenup fiber is cut down at one A of diametrically opposite ends thereof, while it is bundled at the other end B, thereby giving a fiber bundle consisting of 0.9 million fibers. The reason why the number of fibers is set in this way is that the content (Vf) by volume of the fiber shaped article is set at 30% from the relationship with the inside diameter of a shaping glass pipe which will be described hereinafter.

An acrylic resin-based solution [ORIBAN (BPS4668) made by Toyo Ink, k.k.] is mixed with acetone as a solvent at a proportion of 1:1, and a curing agent (polyisocyanate) is added to this mixture in an amount corresponding to 4% of the acrylic resin-based solution to prepare a binder solution. Ti powder having a particle size of 325 meshes or less for preventing cohesion of fibers is added to the binder solution in a proportion of 100 g/l.

Figure 5B:
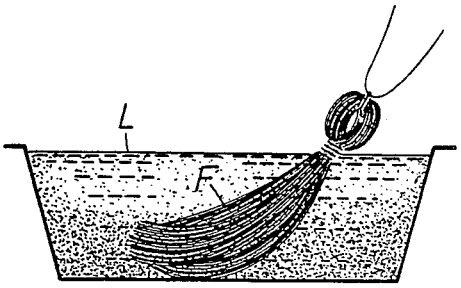

As shown in FIG. 5*b*, the fiber bundle F is immersed into the binder solution L, and the binder solution L containing the Ti powder is allowed to permeate fully the spaces between the fibers of the fiber bundle F with stirring while shaking the fiber bundle F.

Figure 5C:
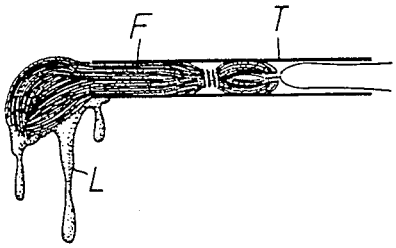

As shown in FIG. 5*c*, the fiber bundle F withdrawn out of the binder solution L is passed through the inside of a glass pipe T having an inside diameter of 12 mm to squeeze the extra binder solution L and the opposite ends of the fiber bundle F are cut down to give a preshaped product of 12 mm diameter and 20 mm length.

Figure 5D:
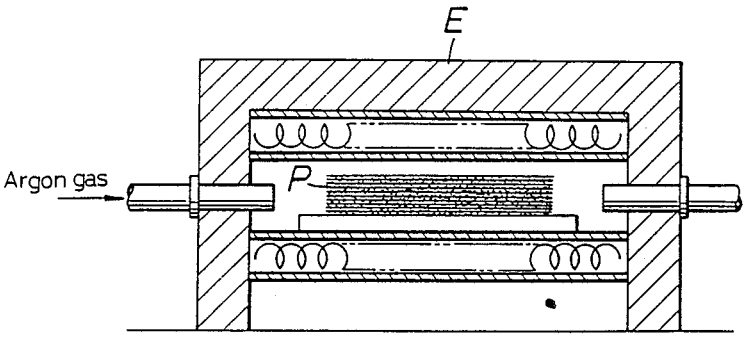
Figure 7:
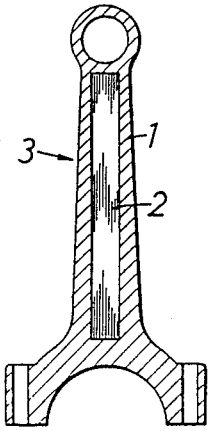
FIG. 7 is a longitudinally sectional front view of a connecting rod for internal combustion engines.

As shown in FIG. 5*d*, the preshaped product P dried and cured is placed in an electric furnace E and is subjected to a firing treatment for one hour at 400° C. in an argon gas atmosphere to give a rod-like fiber shaped article. The organic components have been decomposed and removed by the above firing treatment, and therefore, the content of the organic components remaining in the fiber shaped article is of 5% of that before firing.

| Alloy | Chemical constituents (% by weight) | | | | |
|---|---|---|---|---|---|
| No. | Al | Zn | Mn | Si | Mg |
| (i) | 0.3 | 0.1 or less | 0.2 | 0.1 or less | balance |
| (ii) | 2.0 | 0.1 or less | 0.2 | 0.1 or less | balance |
| (iii) | 2.96 | 0.68 | 0.12 | 0.1 or less | balance |
| (iv) | 3.8 | 0.1 or less | 0.3 | 0.1 or less | balance |
| (v) | 4.6 | 0.1 or less | 0.1 or less | 0.78 | balance |
| (vi) | 6.0 | 2.8 | 0.3 | 0.1 or less | balance |
| (vii) | 8.8 | 0.6 | 0.28 | 0.1 or less | balance |
| (viii) | 10.17 | 0.1 or less | 0.18 | 0.1 or less | balance |

The above fiber shaped article is heated at 400° C. in an argon gas atmosphere and then placed into a cavity in a mold. Thereafter, a molten metal of magnesium alloy (i) to (viii) at 730° C. is immediately poured into the cavity and is subjected to the action of a pressure of 1,000 kg/cm$^2$ for 60 seconds, thus providing 8 types of rod-like carbon fiber-reinforced metallic materials having a diameter of 12 mm and a length of 120 mm.

Figure 6:
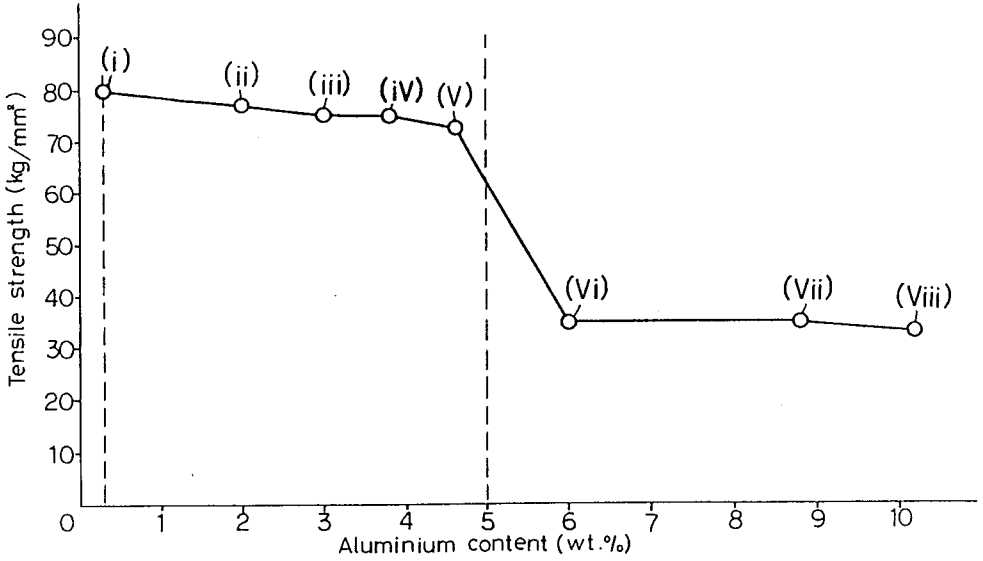
FIG. 6 is a graph illustrating the relationship between the aluminum content of the various materials and the tensile strength thereof.

FIG. 6 illustrates the relationship between the content of the aluminum alloy and the tensile strength for each material. In FIG. 6, the reference characters (i) to (viii) correspond to the materials containing the aforesaid magnesium alloys (i) to (viii) as a matrix, respectively.

As apparent from FIG. 6, as the content of aluminum as a matrix increases, the tensile strength gradually decreases, but it the content of aluminum is of 5.0% by weight or less, the tensile strength of a level sufficient for pracical use can be assured.

If the aluminum content exceeds 5.0% by weight, the tensile strength suddenly reduces and hence, a material containing an aluminum alloy of such a content cannot be provided for practical use the reason is in that if the aluminum content exceeds 5.0% by weight, the formation of an embrittled layer due to the reaction of aluminum with carbon fiber is increased and also, the formation of a brittle intermetallic compound layer such as $Al_{12}Mg_{17}$ is increased.

For a material containing magnesium alone as a matrix, a satisfactory compounding cannot be carried out because of a smaller thermal capacity of the magnesium alone and a poor flowability of the melt thereof.

The above-described material is applied, for example, to a connecting rod 3 for internal combustion engines which has a shank 1 reinforced with a rod-like carbon fiber shaped article 2 axially disposed.

What is claimed is:

1. A method for producing a carbon fiber-reinforced metallic material, comprising the steps of:

forming a fiber shaped article from a mixture of carbon fibers with a metal powder which is oxidizable to generate heat prior to oxidation of said carbon fiber;

preheating, in a non-oxidative atmosphere, said fiber shaped article;

exposing said preheated fiber shaped article to the ambient atmosphere, permitting said metal powder to be oxidized to generate heat; and filling said fiber shaped article with a molten metal and solidifying the molten metal, wherein the oxidation of the metal powder generates heat and suppresses the oxidation of the carbon fibers.

2. A method for producing a carbon fiber-reinforced metallic material according to claim 1, wherein said metal powder is at least one selected from the group consisting of Ti, Zr and Fe powders.

3. A method for producing a carbon fiber-reinforced metallic material according to claim 1 or 2, wherein the temperature of preheating of said fiber shaped article is set at 600° C. or more.

4. A carbon fiber-reinforced metallic material prepared according to the method of claim 1, wherein the material comprises a magnesium-aluminum alloy matrix which is reinforced with a carbon fiber, in which the aluminum content of the magnesium-aluminum alloy is about 0.3 to about 5 percent by weight of the alloy.

5. A connecting rod for an internal combustion engine comprising, a shank which is reinforced by a carbon fiberreinforced metallic article, said article being prepared according to the method of claim 1, being in the form of a rod, and being axially disposed with respect to said shank.

* * * * *